United States Patent [19]

Brown

[11] Patent Number: 5,050,653

[45] Date of Patent: Sep. 24, 1991

[54] LAMINATED WOOD PROCESS FOR USING WASTE OFFCUT STRIPS AND PRODUCTS THEREOF

[76] Inventor: Donald W. Brown, 12 Trimont Trail, Franklin, N.C. 28734

[21] Appl. No.: 531,743

[22] Filed: Jun. 1, 1990

[51] Int. Cl.[5] ..... B27G 11/00

[52] U.S. Cl. ..... 144/351; 144/347; 144/350; 144/355; 156/91; 156/266; 156/304.1

[58] Field of Search ..... 428/50, 54, 64, 27, 428/106, 535; 156/258, 264, 266, 299, 304.1, 304.5, 94; 144/344, 345, 347, 348, 350, 351, 354, 355

[56] References Cited

U.S. PATENT DOCUMENTS

| | | | |
|---|---|---|---|
| 301,068 | 6/1884 | Parmelee | 144/350 |
| 392,809 | 11/1888 | Kelley | 144/350 |
| 781,376 | 1/1905 | Sorensen | 144/346 |
| 1,594,889 | 8/1926 | Loetschere | 144/351 |
| 1,638,262 | 8/1927 | Herzog | 144/351 |
| 1,924,240 | 8/1933 | Harwell | 144/347 |
| 2,544,935 | 3/1951 | Orner | 144/350 |
| 3,730,820 | 5/1973 | Fields et al. | 144/346 |
| 3,986,543 | 10/1976 | Slayton et al. | 144/236 |

FOREIGN PATENT DOCUMENTS

| | | | |
|---|---|---|---|
| 207549 | 2/1960 | Austria | 144/350 |
| 2404898 | 8/1975 | Fed. Rep. of Germany | 144/346 |

*Primary Examiner*—W. Donald Bray
*Attorney, Agent, or Firm*—Berman & Aisenberg

[57] ABSTRACT

A process for making a laminated wood product includes sawing or sanding opposite faces of offcut wood strips, to prepare these faces for glueing with the strips in quartersawn orientation. The strips are also prepared by sanding or planing substantially parallel to the top and/or bottom surfaces of the strips. The strips are glued end-to-end and side-by-side to form a laminated plank having the strips in quartersawn orientation. The plank is finished to form a laminated quartersawn strip product which may be used for flooring, paneling, millwork or other purposes.

17 Claims, 1 Drawing Sheet

LAMINATED WOOD PROCESS FOR USING WASTE OFFCUT STRIPS AND PRODUCTS THEREOF

FIELD OF THE INVENTION

This invention relates to laminating offcut wood strips, such as waste offcut strips, for making flooring, paneling, baseboard, millwork or other products.

BACKGROUND OF THE INVENTION

Known laminated wood products, such as flooring, do not make use of the supply of offcuts generally considered to be waste material. Abendroth, U.S. Pat. No. 4,784,887, describes a flooring laminate having a surface composed of edge grain plain sawn wood veneer strips bonded to each other in parallel stacked relationship so that the edges of the veneer strips are coplanar, providing a floor surface of bonded edge grain veneer strips. According to the Abendroth patent, the edge grain strips are formed of veneer edges. Drobina, U.S. Pat. No. 4,293,362, describes a method of forming decorative panels in which a plurality of edge glued thin wood strips are laid in side-by-side relationship and glued together to form a single composite sheet which is then cut into pieces and glued onto a wooden backing sheet to form a decorative panel.

The patent to Fields, U.S. Pat. No. 3,730,820, describes a softwood/hardwood laminated panel in which strips of softwood and strips of hardwood are alternated so that the edge grain provides the wear surface. The hardwood strips provide long life to the panel, which may be used for a truck deck, and the softwood strips allow objects to slide easily over the deck. Fountain, U.S. Pat. No. 3,041,231, describes a method of laminating rotten grade wood to make laminated boards. Inner boards may have through holes, but outer boards have no rotten portions in the outer surface.

Parmelee, U.S. Pat. No. 301,068, describes a method of laminating wood to form a piano sounding board. Parmelee selects quartersawn wood due to its sensitivity to sound vibrations and its high degree of sound transmission, and laminates the board to provide even density of the wood stock through the sounding board.

SUMMARY OF THE INVENTION

Offcut wood strips are considered to be waste product from manufacturing processes, and are available at relatively low cost. The process described herein uses flatsawn hardwood offcut strips for making a laminated plank using the strips in quartersawn orientation. Hardwood flooring, strip millwork or other products are made by finishing the laminated planks. Alternatively, the laminated planks may be sold, without finishing, ready for immediate use or for finishing.

Quartersawn wood is sawn radially. For quartersawn planks, a log is cut radially into quarters and then into boards or planks in which the annual rings are at or nearly at right angles to the wide face to secure lumber that will warp relatively little, be dimensionally stable in high humidity and will show grain advantageously.

An offcut strip used as starting material for a process of the invention is a flatsawn strip which is a waste offcut from a plank cut tangentially to the log. Such a flatsawn strip is a strip from a plank which is sawn lengthwise from the log by sawing parallel to a longitudinal axis of the log in successive parallel cuts. A flatsawn plank generally has a substantially flat grain surface in which the annual rings are or are nearly parallel to the wide face of the plank. This strip is turned lengthwise through 90 degrees to provide a face having quartersawn orientation, i.e. with the annual rings at or nearly at right angles to the upper surface.

In general, a face having the annual rings at 45 degrees or less to a surface is considered to be a flatsawn strip. A face having the annual rings at 45 degrees or more to a surface is considered to be a quartersawn strip.

A process for making a laminated wood product includes sawing and/or sanding opposite flatsawn faces of offcut wood strips, of various lengths and widths, previously considered to be waste products. These faces are then prepared for glueing with the strips having their upper edges in quartersawn orientation, similar to an upper face of a quartersawn plank in which the annual rings are at or nearly at right angles to the upper surface. The strips are trimmed to substantially the same height and glued end-to-end and side-by-side to form a laminated plank. The laminated plank may be sawn substantially parallel to its top and bottom surfaces to form at least two laminated planks. The plank material may be finished to form a laminated quartersawn strip product such as flooring, paneling, millwork or other product.

It is an object of the invention to provide a process for laminating offcut wood strips.

It is another object of the invention to provide a process for making laminated planks of offcut wood strips.

It is a further object of the invention to provide laminated quartersawn wood strip products from waste offcuts.

DETAILED DESCRIPTION OF THE INVENTION

Figure 1:
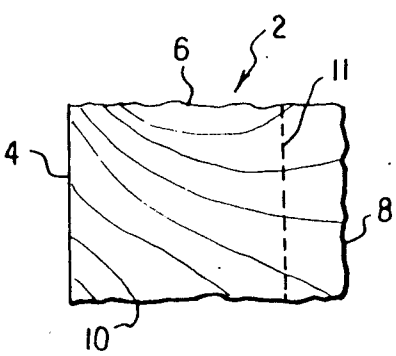
FIG. 1 is an end view of a wood strip offcut useful for practicing the invention.

The laminated wood product and process of the invention is particularly advantageous in profitably using offcuts of wood strips, such as rippings, which otherwise are waste material. Hardwood, such as red oak, is preferred, but any hardwood or softwood may be used. Offcuts are generally discarded or sold off cheaply as few uses are known for such offcuts.

It has now been unexpectedly discovered that turning flatsawn strip offcuts edgeways to quartersawn orientation, and glueing and sawing the offcuts to form a plank, allows solid wood laminated products, such as flooring, paneling and millwork, to be made economically. These are non-limiting examples and other uses are within the scope of the invention. Laminated strip flooring can be made from hardwood offcuts, according to the process described herein, with little waste. Such laminated solid hardwood flooring can be refinished several times. In contrast, flooring which has a surface veneer on a plywood or other base, cannot generally be refinished. Parquet flooring can also be made by the process described by cutting the planks appropriately, as known to those skilled in the art.

As many strips as required can be laminated together to form a plank of any suitable width. The strips can be joined lengthwise by butting together and glueing. Thus a laminated plank of any required length and width may be made.

Wood strip offcuts, either hardwood or softwood, generally have one smooth surface which has been rip sawn and three rough sawn edges. A typical offcut is flatsawn, kiln-dried wood and is about ¾ in. to 2½ in. wide, about 1 in. to 2½ in. thick, and from 12 in. upward in length.

Quartersawn wood is obtained when a log is sawn radially. For quartersawn planks, a log is cut radially into quarters and then into boards or planks in which the annual rings are at or nearly at right angles to the wide face to secure lumber that will warp relatively little, be dimensionally stable in high humidity and will show grain advantageously.

An offcut strip used as starting material for a process of the invention is a flatsawn strip which is a waste offcut from a plank cut tangentially to the log. Such a flatsawn strip is a strip from a plank which is sawn lengthwise from the log by sawing parallel to a longitudinal axis of the log in successive parallel cuts. A flatsawn plank generally has a substantially flat grain upper surface in which the annual rings are or are nearly parallel to the wide face of the plank. This strip is turned lengthwise through 90 degrees to provide an upper surface having quartersawn orientation, i.e. with the annual rings at or nearly at right angles to the upper surface.

In general, a surface having the annual rings at 45 degrees or less to the surface is considered to be a flatsawn strip. A surface having the annual rings at 45 degrees or more to the surface is considered to be a quartersawn strip.

According to a process of the invention, opposite flatsawn faces of an offcut are first sanded to make glueable surfaces for laminating the offcuts together. The sanded offcut strips are ripsawn (or otherwise prepared) to the required width and the strips are then turned sideways and glued in quartersawn orientation, as described above.

Quartersawn lumber has greater dimensional stability than flat sawn lumber, since wood expands and contracts to a much greater degree tangentially than it expands radially. In addition, the laminating process adds strength to the product due to the strength of the glue joints. Products of the invention are humidity resistant due to the quartersawn orientation of the strips and the strength added by the glued joints. Planks manufactured according to the process described will be highly resistant to warping. Warping is a disadvantage of single board flooring, paneling or millwork. Quartersawn laminated planks shrink minimally due to the dimensional stability of the planks, thus avoiding unsightly gaps between installed material. Flooring of the invention is suitable for use in humid locations, such as basements, and for installation in coastal regions or other humid areas.

Offcuts are generally of varying lengths and, when the offcut strips are joined end to end and formed into a plank, a standard length of laminated plank, such as a 6 ft. or 8 ft. plank, may be made. Alternatively, shorter or longer lengths may be made. Either offcuts can be glued end-to-end until the required length is exceeded, or offcuts can be prepared to various lengths and joined to form the required length of plank. Joints in adjacent strips forming a plank should be staggered along the length of the plank.

In a preferred process according to the invention, offcut strips are ripsawn and arranged in adjacent rows of strips. Each row can be a full length strip or a combination of several shorter pieces having a total length of a full length plank. The rows of strips organized to the size and shape of the required plank are then pressed together from the top, sides and ends in a large glueing machine and laminated to form a sturdy plank.

When the offcuts have been glued together to make a rough plank of approximately the required length and width, the plank is resawn to the length required for making the end product. Offcuts may be thick enough to make more than one plank of laminated product from each rough plank.

After sawing to a particular size, the product may be finished to make, for example, flooring, wall paneling, or used for millwork, such as baseboards and crown moldings. For use as paneling, the product may be made the same thickness as drywall to facilitate fastening the paneling to wall studs. Flooring material of the invention may be strip flooring, such as tongue and groove strip flooring, or parquet block flooring. For flooring or wall paneling use, edges of the strip panels may be straight cut or bevelled. Alternatively, the unfinished laminated planks may be sold for use as is, or for finishing.

Figure 2:
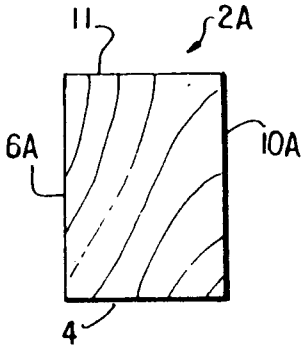
FIG. 2 is an end view of the offcut of FIG. 1 after cutting.

With reference to the Figures, in which like numerals represent like parts, FIGS. 1 to 8 show typical offcuts at each stage of the process from the beginning to the finished product. FIG. 1 shows an end view of flat sawn offcut 2 which is of any length up to about 16 ft. and which is rip sawn at edge 4 and rough sawn on edges 6, 8 and 10. Offcut 2 is turned to quartersawn orientation. Opposite edges 6 and 10 are then sanded or abrasive planed to form edges 6A and 10A of offcut 2A, as shown in FIG. 2. Offcut 2 is then ripsawn to the required width along line 11 (shown as a broken line in FIG. 1) parallel with edge 4, so that offcuts 2 forming a single plank are substantially the same height when turned to quartersawn orientation and glued. Cut strips of substantially the same height are preferred for allowing application of top pressure during the glueing process, as discussed below. Sanded edges 6A and 10A are of glue joint quality. Alternatively, the strips may be glued into a rough plank before sawing to even height.

Figure 3:
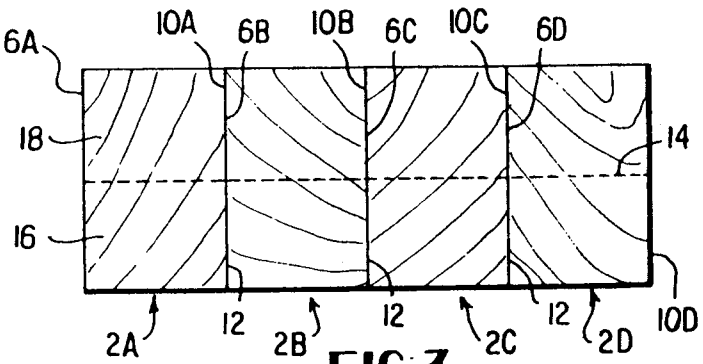
FIG. 3 is an end view of a plank formed by laminating offcuts of FIG. 2 side-by-side, in which the broken lines represent saw cuts.

FIG. 3 shows a plurality of offcuts 2A, 2B, 2C and 2D glued together at joints 12 in quartersawn orientation. Joints 12 are formed by joining faces 10A and 6B of offcuts 2A and 2B respectively, by joining faces 10B and 6C of offcuts 2B and 2C respectively, and by joining faces 10C and 6D of offcuts 2C and 2D respectively. Any suitable glue may be used, such as waterproof glue made by Franklin Adhesives, Columbus, OH. Broken line 14 in FIG. 3 is a line for sawing to make two planks 16 and 18 for finishing, if required. Any appropriate number of saw cuts may be made to make one or more planks for finishing. The width of planks 16 and 18 may be altered by changing the number of offcuts glued side-by-side.

In putting strips together for glueing, strips of substantially the same thickness are chosen, where possible. If a thicker piece is needed, for example for making certain types of millwork, the full thickness may be used, instead of cutting the plank into several portions for finishing. Offcuts 2A, 2B, 2C and 2D may be only thick enough for cutting a single plank for finishing.

Figure 4:
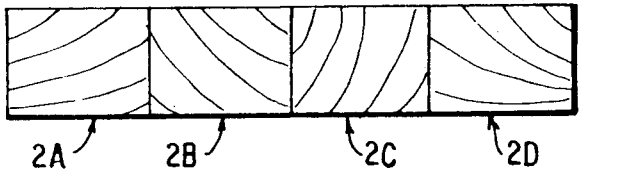
FIG. 4 is an end view of a plank of FIG. 3 after sawing of the cuts shown in FIG. 3.
Figure 5:
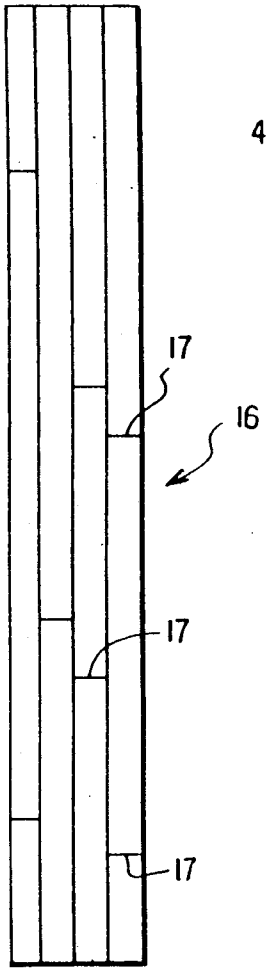
FIG. 5 is a schematic top view of a plank of FIG. 4 showing butted joints between strips.

The laminated section shown in FIG. 3 may be made as long as needed, by glueing together sufficient offcuts, butted end-to-end. Butted joints on adjacent strips of the laminated plank should be staggered along the length of the plank. FIG. 4 shows an end view of laminated plank 16 ready for finishing, such as for making flooring or paneling, or for further cutting, such as for millwork. FIG. 5 shows a schematic top view of plank 16 of FIG. 4 having butted joints 17 along the length of the plank, joining the offcuts end-to-end to form a plank of required length, such as 4 ft., 6 ft., 8 ft. or other length known to one skilled in the art.

In a non-limiting example, planks of FIG. 5 are glued together using waterproof glue (such as is manufactured by Franklin Adhesives, Columbus, OH), in a 50 in.×100 in. machine having hydraulic cylinders at one end and a fixed pressure plate at the other end. A steel bar with a thick rubber pad is placed between the blank assemblies and the cylinders. When the cylinders are activated, the moving bar applies end pressure to the plank assemblies thereby closing any gaps between partial length pieces within the plank assemblies. The rubber pad absorbs any slight differences in the lengths of the individual strips. Additionally, side and top pressure is applied to the plank to insure tightly glued joints and planar upper and lower surfaces. The planks are cured overnight and are resawn to the required thickness using a band resaw. The planks are then machined appropriately for creating the finished product.

Figure 6:
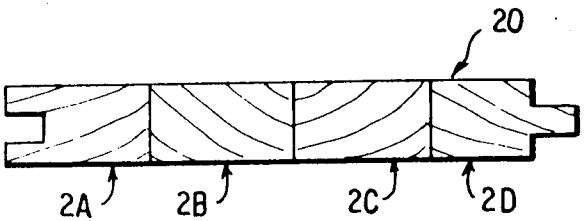
FIG. 6 is an end view of a finished piece of tongue and groove strip flooring made from a plank of FIG. 4.
Figure 7:
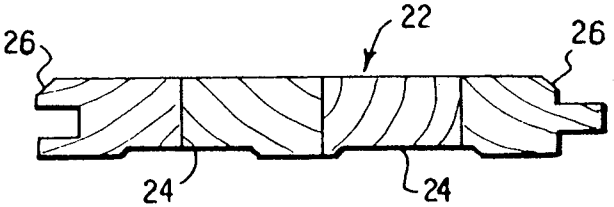
FIG. 7 is an end view of another finished piece of tongue and groove strip flooring.
Figure 8:
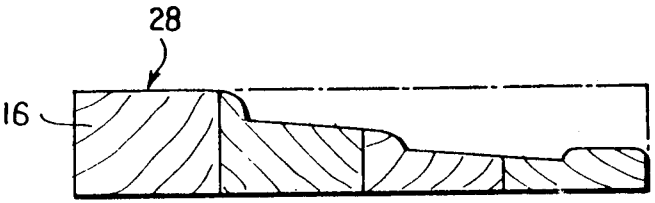
FIG. 8 is an end view of strip millwork showing, in phantom, a plank of FIG. 4 from which the millwork is cut.

FIG. 6 shows a finished piece of tongue and groove flooring 20, which has been further sawn, and which may be sanded, stained and finished with a protective coating, such as polyurethane. FIG. 7 shows an alternative strip flooring 22 having channels 24 for venting air and moisture on the underside of panel 22, and also having bevelled edges 26 which form a V-groove when adjacent panels are abutted. FIG. 8 shows an example of millwork, such as molding 28 which may be cut from a plank 16 of FIG. 4.

While the invention has been described above with respect to certain embodiments thereof, variations and modifications may be made without departing from the spirit and scope of the invention.

What is claimed is:

1. A process for making a quartersawn laminated wood plank from flatsawn offcut strips having top and bottom surfaces and two opposite sides, said process comprising:

preparing opposite sides of flatsawn wood offcut strips for glueing in quartersawn orientation;

preparing top surfaces of said flatsawn wood offcut strips to make each of said flatsawn offcut strips substantially the same height; and glueing said opposite sides of said wood strips to adjacent sides of adjacent wood strips to form a laminated plank having said wood strips in quartersawn orientation with respect to top and bottom surfaces of said plank, wherein said top and bottom surfaces of said laminated plank each include at least one joint between glued strips.

2. A process according to claim 1 further comprising glueing ends of strips in addition to glueing sides of strips and adhering said strips in both end-to-end and side-to-side relationship whereby a laminated plank of the required length and width is made.

3. A process according to claim 2 further comprising sawing said plank substantially parallel to said top and bottom surfaces to form at least two laminated quartersawn planks.

4. A process according to claim 2 further comprising finishing said laminated plank to form flooring.

5. A process according to claim 4 further comprising finishing said substantially smooth laminated plank to form tongue and groove flooring.

6. A process according to claim 2 further comprising finishing said substantially smooth laminated plank to form tongue and groove strip paneling.

7. A process according to claim 2 further comprising finishing said substantially smooth laminated plank to form strip millwork.

8. A process according to claim 2 further comprising finishing said substantially smooth laminated plank to form strip baseboard.

9. A process for making a quartersawn laminated wood product from flatsawn waste offcuts comprising:

sawing flatsawn hardwood offcut strips to prepare opposite sides for glueing said strips in quartersawn orientation;

preparing top surfaces of said flatsawn wood offcut strips to make each of said flatsawn offcut strips substantially the same height; and glueing said strips in end-to-end and side-to-side relationship to form a laminated plank comprising adjacent glued offcut strips in quartersawn orientation wherein top and bottom surfaces of said rough plank include at least one joint between said glued strips.

10. A process according to claim 9 further comprising sawing said laminated plank substantially parallel to said top and bottom surfaces to form at least two laminated planks.

11. A process according to claim 9 further comprising finishing said laminated plank to form a finished laminated quartersawn hardwood product.

12. A process according to claim 11 further comprising finishing said laminated plank to form tongue and groove flooring.

13. A process according to claim 11 further comprising finishing said laminated plank to form strip millwork.

14. A process according to claim 11 further comprising finishing said substantially smooth laminated, quartersawn plank to form tongue and groove paneling.

15. A process according to claim 11 further comprising finishing said substantially smooth laminated, quartersawn plank to form baseboard.

16. A process according to claim 12 further comprising bevelling upper side edges of said tongue and groove flooring.

17. A process according to claim 12 further comprising forming at least one ventilation channel extending below a lower surface of said flooring.

* * * * *